United States Patent [19]

Woodward

[11] 4,328,773

[45] May 11, 1982

[54] DIESEL ENGINE SHUTOFF ACTUATOR

[75] Inventor: Ronald O. Woodward, Muncie, Ind.

[73] Assignee: General Motors Corporation, Detroit, Mich.

[21] Appl. No.: 183,103

[22] Filed: Sep. 2, 1980

[51] Int. Cl.[3] ..... F02B 77/08

[52] U.S. Cl. ..... 123/198 DB; 123/179 G; 123/179 L; 123/366

[58] Field of Search ..... 123/198 D, 198 DB, 179 L, 123/179 G, 366, DIG. 11

[56] References Cited

U.S. PATENT DOCUMENTS

| | | | |
|---|---|---|---|
| 3,603,300 | 9/1971 | Moffett | 123/198 DB |
| 3,918,318 | 11/1975 | Phillips | 123/198 DB |
| 4,124,013 | 11/1978 | Rivalto | 123/198 DB |
| 4,160,916 | 7/1979 | Papasideris | 123/198 D |
| 4,177,788 | 12/1979 | Morita et al. | 123/179 L |
| 4,192,279 | 3/1980 | Maisch et al. | 123/198 DB |
| 4,212,272 | 7/1980 | Hawk | 123/198 DB |
| 4,212,278 | 7/1980 | Eisinger et al. | 123/198 DB |

*Primary Examiner*—Ira S. Lazarus

*Attorney, Agent, or Firm*—Warren D. Hill

[57] ABSTRACT

An actuator is provided to selectively turn a diesel engine governor shutoff shaft to fuel "off" or fuel "on" position in response to keyswitch operation. An electric motor coupled through a gear train to a shutoff lever turns the lever to "on" or "off" position. A relay circuit controls the motor operation in response to keyswitch position and shutoff lever position. A feedback element moving with the shutoff lever mechanically interrupts the relay circuit by overriding the relay contact state to turn off the motor whenever the shutoff lever reaches an "on" or "off" position.

3 Claims, 4 Drawing Figures

DIESEL ENGINE SHUTOFF ACTUATOR

This invention relates to a diesel engine shutoff actuator and in particular to such an actuator which turns fuel on or off in response to keyswitch operation.

In order to turn off the diesel engines in trucks it has been the conventional practice to provide a manually operated cable which is effective to turn off the engine fuel when operated. Thus, the operation of a truck differs from that of an automobile where merely operation of a keyswitch is required to start or stop the engine. It has been proposed to operate a diesel fuel shutoff mechanism by an electric motor responsive to a keyswitch, however, that proposal required a complicated electrical circuit for controlling the motor.

It is, therefore, an object of this invention to provide a diesel fuel shutoff actuator with a simple circuit responsive to a keyswitch for operating the actuator motor.

The invention is carried out by providing an electric motor coupled with a fuel shutoff control member, a relay circuit responsive to a keyswitch position for driving the motor in a direction to move the shutoff member to "on" or "off" position and a mechanical feedback element to interrupt the motor circuit by operation of the relay switches when the shutoff control member reaches "on" or "off" position.

The above and other advantages will be made more apparent from the following specification taken in conjunction with the accompanying drawings wherein like reference numerals refer to like parts and wherein.

Figure 1:
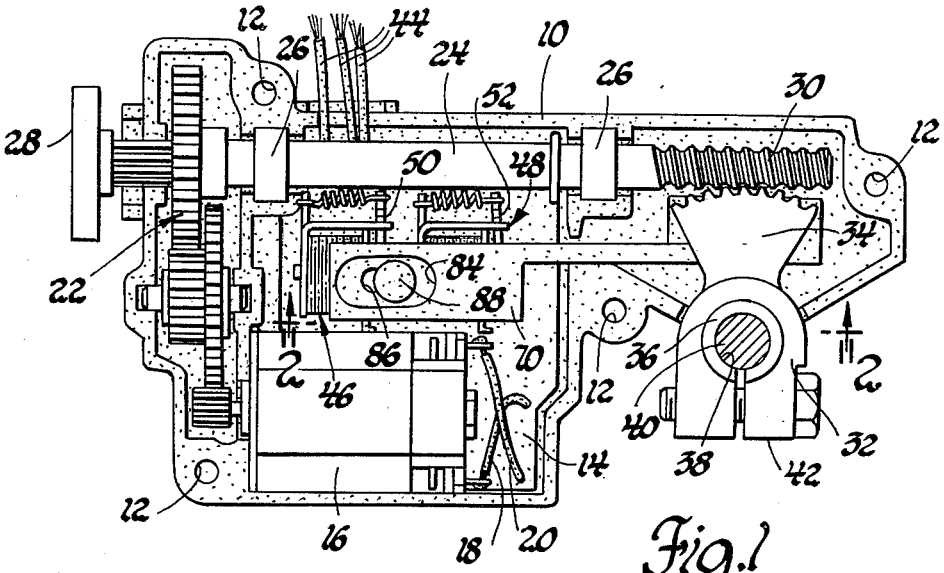
FIG. 1 is a plan view of the diesel engine shutoff actuator according to the invention with the housing cover removed.

Referring to FIG. 1 a molded polymer housing 10 is configured to hold a number of operating elements to be described below and to support each elemnt in its operating position. The housing includes a cover, not shown, which complements the support function of the housing. Apertures 12 are provided for securing the cover to the housing 10. A printed circuit board 14 nested in the housing supports a reversible DC permanent magnet motor 16 which is connected to the circuit board 14 by conductors 18 and 20. The output shaft of the motor 16 is coupled by a gear train 22 to a screw shaft 24 which extends longitudinally of the housing. The screw shaft is rotatably carried by a pair of brass journals 26 which are nested in the molded housing 10. One end of the screw shaft 24 extends outside the housing and is secured to a knob 28 which turns with the shaft. The other end of the shaft 24 has a worm gear thread 30 formed thereon. A shutoff lever or control element 32 carries a gear segment 34 which meshes with the thread 30 for operation thereby. The lever 32 has hub portions 36 extending from either side which are journalled in apertures, not shown, in the housing 10 and its cover to thereby permit rotation of the lever 32 upon operation of the screw shaft 24. A bore 38 in the shutoff lever concentric with the hub 36 contains the diesel engine governor shutoff shaft 40. A clamp 42 integral with the shutoff lever 32 securely fastens the shutoff shaft 40 to the shutoff lever 32 to rotate therewith. Thus, rotation of the motor 16 results in rotation of the shutoff lever 32 and the shaft 40.

Figure 2:
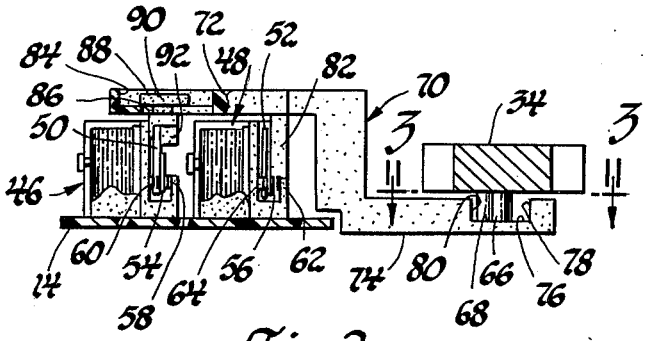
FIG. 2 is a partially cross-sectioned transverse view taken along lines 2—2 of FIG. 1 revealing the feedback element and electrical relays.

The printed circuit board 14 has three electrical conductors 44 connected thereto which extend through the housing. The printed circuit board also carries two relays 46 and 48. As shown in FIGS. 1 and 2, those relays include spring biased armatures 50 and 52 respectively which carry corresponding movable contacts 54 and 56. Relay 46 has two stationary contacts 58 and 60. The movable contact 54 is spring biased against the contact 58 but when the coil of the relay is energized, the movable contact is pulled by the magnetic field of the coil against the contact 60 and away from the contact 58. In the same way the relay 48 has a fixed contact 62 which is normally closed with respect to the movable contact 56 and in stationary contact 64 which is normally open with respect to the movable contact.

As shown in FIG. 2, the gear segment 34 carries on its under surface a pair of control pins 66 and 68. A feedback element or member 70 formed of insulating material selectively engages the armatures 50 and 52 of the relays and also engages the control pin 66 and 68 so that the movement of the shutoff lever 32 can cause longitudinal sliding of the control element 70 to effect selective mechanical operation of the relay armatures 50 and 52. The element 70 is Z-shaped and has an upper bar 72 extending above the relays and a lower bar 74 extending beneath the gear segment 34 to engage the pins 66 and 68. A cavity 76 in the bar 74 defines walls 78 and 80 which are each engaged by a control pin to effect movement of the control element 70. The cavity 78 is considerably larger than the control pins so that a lost motion connection is provided. Thus, the principle portion of the travel of the gear segment 34 does not cause movement of the feedback element 70 and only at the extremes of gear segment travel do the control pins engage the wall 78 or 80 to cause control element shifting. A finger 82 depending from the top bar 72 and integral therewith extends alongside the armature 56 of relay 48 to force it toward the relay coil and engage the contact 56 with the contact 64 when the shutoff lever reaches its "off" position as shown in FIG. 2. A recess 84 in the upper surface of the top bar 72 contains a slot 86 which slidably retains a pin 88. The pin is held in the slot by a large head 90 which overlaps the sides of the slot 86. The pin has a bifurcated end 92 straddling the relay armature 50 and is so arranged that when the shutoff lever is moved to the fuel "on" position the feedback element 70 and the pin 88 moves to the right and pulls the armature 50 away from the relay coil to close the contacts 54 and 58. The pin and slot arrangement 86–88 allows a lost motion connection so that the pin 88 freely rides in the slot until the extreme fuel "on" position is reached whereupon the end of the slot 86 acts against the pin 88 to affect relay switching.

Figure 3:
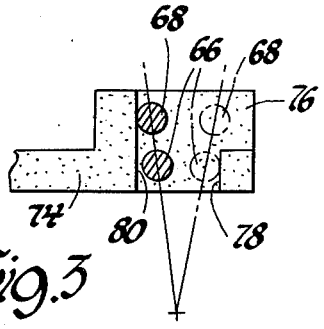
FIG. 3 is a plan view of a portion of the feedback element taken along lines 3—3 of FIG. 2.

As shown in FIG. 3, the cavity 76 in the lower bar 74 is shaped so that the wall 78 engages only pin 66 when the gear sector 34 rotates to the extreme clockwise position whereas the pin 68 contacts the wall 80 when the gear sector 34 rotates to the extreme counterclockwise position. The fuel shutoff shaft 40 in the engine governor is spring loaded in such a way that when it is turning counterclockwise it is pushing against the spring force and thus tends to move more slowly and to stop movement more quickly during motor coastdown after motor de-energization than occurs in the clockwise direction where the spring loading actually assists the shaft rotation. Thus, there is a tendency to move the feedback element 70 further during the coastdown period in the clockwise direction than in the counterclockwise direction. The use of the two pins 66 and 68 at different distances from the center of rotation of the lever compensates for the difference in motor coastdown since the pin 68 moves the feedback element 70 further than does the pin 66 for a given increment of shutoff lever rotation. This features assures that when the circuit to the motor is interrupted by the movement of the control element 70 the continued movement of the element during the coastdown period will be the same regardless of the direction of rotation. Then the movement of the movable contact from its initial position to its final position will be the same in either case. The coastdown distance is just sufficient to cause the movable relay contact to break with one stationary contact and close with the other.

Figure 4:
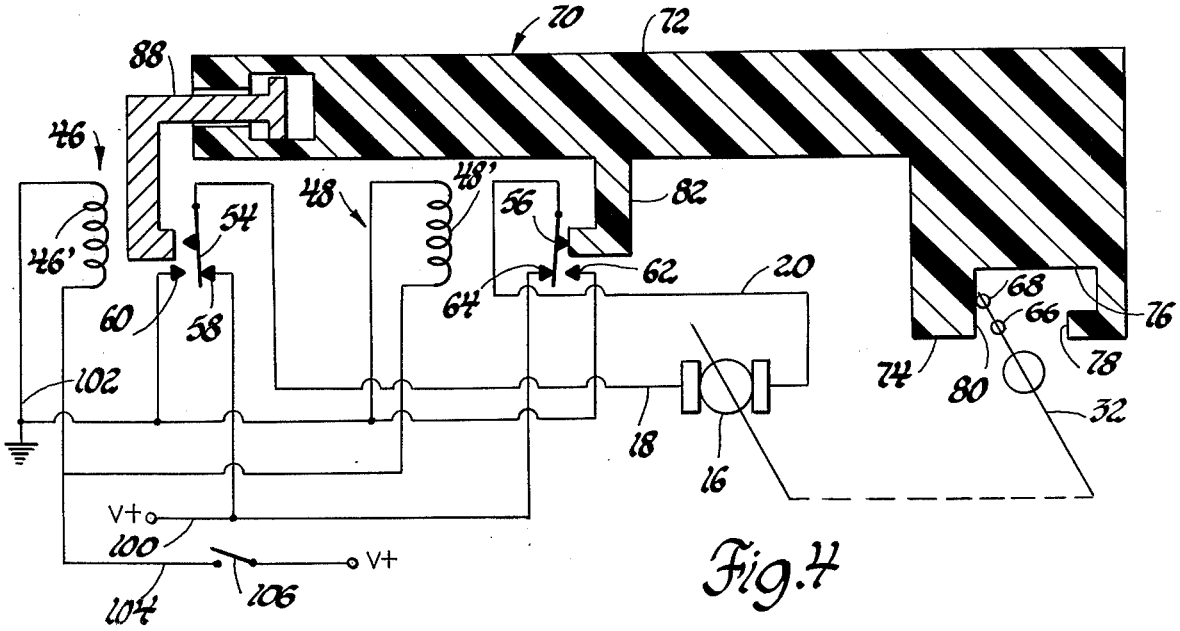
FIG. 4 is a schematic diagram of the actuator circuit according to the invention including the mechanical feedback element.

Referring to FIG. 4 the circuit which actually resides on the printed circuit board 14 is shown in schematic form. The three conductors 44 (FIG. 1) leading to the printed circuit board comprise a conductor 100 connected to a voltage source V+ and which is connected to the stationary contacts 58 and 64 of the relays, a ground wire 102 which is connected to the stationary contacts 60 and 62 of the relays as well as to one side of the relay coils 46' and 48' and a third conductor 104 which is connected between the other side of the relay coils 46' and 48' and a keyswitch 106 which, in turn, is supplied by V+ voltage. The conductors 18 and 20 leading to the terminals of the motor 16 are connected to the movable relay contacts 54 and 56 respectively.

When the keyswitch 106 is open, the relay coils are both de-energized and the movable contacts 54 and 56 are spring biased toward the contacts 58 and 62 respectively. However, when the actuator is in the fuel "off" position, as shown in FIG. 4, the control element 70 is moved toward the left so that its finger 82 holds the contact 56 against the contact 64 counter to the spring bias of the armature 52. An inspection of the circuit will reveal that in the fuel "off" condition the motor leads 18 and 20 are both connected through the relays to the conductor 100 so that there is no current flow to the motor and it will be stationary. Circuit inspection will also reveal that when both movable contacts are in the relay energized position or state, i.e. engaging contacts 60 and 64, current will be supplied in one direction through the motor and when they are in the relay de-energized position current will flow in the opposite direction. Thus, the relay coils which are in parallel are concurrently energized or de-energized by keyswitch operation to establish motor rotation in a given direction. When the movable contacts are in opposite positions or states, there is no current flow to the motor. Thus, motor operation is halted by moving one movable contact to a position contrary to the state established by its coil. The relay switch is then functioning as a limit switch responsive to the feedback member 70.

To move the actuator to the run or fuel "on" condition, the keyswitch 106 is closed by the operator thereby energizing both relay coils 46' and 48'. Then the contact 54 is pulled against the stationary contact 60 and the movable contact 56 will be maintained in contact with the contact 64 even after movement of the control element 70. This state of the circuit allows current flow from the conductor 100 through the contacts of relay 48, the motor, and the relay 46 to ground thus causing the motor to rotate in a direction to move the fuel shutoff lever 32 clockwise. When that lever approaches its extreme fuel "on" position, the pin 66 engages the wall 78 on the feedback element 70 to move the pin 88 against the armature 50 thereby moving the contact 54 from the contact 60 to the contact 58 to stop the rotation of the motor 16. The terminal leads 18 and 20 of the motor are then in effect interconnected so that dynamic braking occurs to terminate the motor coastdown period.

To move the actuator to fuel "off" condition, the keyswitch is opened by the operator to de-energize both relays. Then the contact 56 will engage contact 62 to supply current to the motor. When the control lever 32 reaches the "off" position, the finger 82 will move contact 56 into engagement with contact 64 as shown in FIG. 4 to stop the motor.

During engine operation an electrical failure will not interfere with the fuel flow since the motor 16 will not move if there is no voltage. However, the fuel can be shut off manually, if desired, by turning the knob 28 on the screw shaft 24.

The embodiments of the invention in which an exclusive property or privilege is claimed are defined as follows:

1. A diesel engine shutoff actuator for effecting cutoff of fuel in response to keyswitch operation to "off" position and fuel turn-on in response to keyswitch operation to "on" position comprising a fuel control element mounted for movement between a fuel "on" and a fuel "off" position, a reversible electric motor drivingly connected to the control element for moving the element from one position to another, a pair of relays each having a switch connected to the motor and a coil connected to the keyswitch for energization to thereby establish relay energization and motor direction state according to keyswitch position, a control circuit including the said relay switches for energizing the motor and determining its direction of rotation according to the energization states of the relays, whereby motor operation in the proper direction can be initiated to drive the control element from one position toward the other position, and a mechanical feedback member coupled to the relay switches and the control element for movement thereby to selectively operate the relay switches as limit switches at the control element "on" and "off" positions respectively to de-energize the motor.

2. A diesel engine shutoff actuator for effecting cutoff of fuel in response to keyswitch operation to "off" position and fuel turn-on in response to keyswitch operation to "on" position comprising a fuel control element mounted for movement between a fuel "on" and a fuel "off" position, a reversible electric motor drivingly connected to the control element for moving the element from one position to another, a pair of relays each having a switch connected to the motor and a coil connected to the keyswitch for energization to thereby establish relay energization state according to keyswitch position, a control circuit including the said relay switches for energizing the motor and determining its direction of rotation according to the energization states of the relays, wherby motor operation in the proper direction can be initiated to drive the control element from one position toward the other position, and a mechanical feedback member connected to the control element for movement thereby and selectively engaging the relay switches at the control element "on" and "off" positions respectively for operating a selected relay switch contrary to the state of relay coil energization to de-energize the motor when the control element reaches the said other position.

3. A diesel engine shutoff actuator for effecting cutoff of fuel in response to keyswitch operation to "off" position and fuel turn-on in response to keyswitch operation to "on" position comprising a fuel control element mounted for movement between a fuel "on" and a fuel "off" position, a reversible electric motor drivingly connected to the control element for moving the element from one position to another, a pair of relays having coils connected in parallel to the keyswitch for concurrent energization to thereby establish relay energization state according to keyswitch position, and switches connected to the motor, the switches each movable between a first and a second state corresponding to the state of its coil energization, a control circuit including the said relay switches for energizing the motor and determining its direction of rotation according to the energization states of the relays, the motor being rotated in a direction to drive the control element to fuel "on" position when both relay switches are in their first stae, in the other direction when both relay switches are in their second state, and stopped when the relay switches are in different states, and a mechanical feedback member connected to the control element for movement thereby and effective when the control element is moved from one position to the other position to selectively engage the relay switches at the control element "on" and "off" positions respectively for changing the state of a selected relay switch contrary to its state of relay coil energization to de-energize the motor when the control element reaches the said other position.

* * * * *